US009057531B2

(12) United States Patent
Huang

(10) Patent No.: US 9,057,531 B2
(45) Date of Patent: Jun. 16, 2015

(54) THERMAL HUMIDIFIER

(71) Applicant: Chin-Cheng Huang, Tainan (TW)

(72) Inventor: Chin-Cheng Huang, Tainan (TW)

( * ) Notice: Subject to any disclaimer, the term of this patent is extended or adjusted under 35 U.S.C. 154(b) by 445 days.

(21) Appl. No.: 13/626,847

(22) Filed: Sep. 25, 2012

(65) Prior Publication Data

US 2014/0084497 A1 Mar. 27, 2014

(51) Int. Cl.
*F24F 6/18* (2006.01)
*F24F 6/02* (2006.01)

(52) U.S. Cl.
CPC .. *F24F 6/18* (2013.01); *F24F 6/025* (2013.01)

(58) Field of Classification Search
CPC ..... F24F 6/025; F24F 6/10; F24F 6/18
USPC ..... 261/142, 104, 107, DIG. 10, DIG. 65, 261/DIG. 76
See application file for complete search history.

(56) References Cited

U.S. PATENT DOCUMENTS 3,355,155 A * 11/1967 Heltzen et al. ..... 261/130
3,977,364 A * 8/1976 Gijsbers et al. ..... 122/366
4,225,542 A * 9/1980 Wall et al. ..... 261/142
4,419,302 A * 12/1983 Nishino et al. ..... 261/142
4,652,408 A * 3/1987 Montgomery ..... 261/130
5,771,845 A * 6/1998 Pistien et al. ..... 122/366
5,903,223 A * 5/1999 Howell ..... 340/620
5,916,493 A * 6/1999 Miller ..... 261/154
6,397,786 B1 * 6/2002 Wu ..... 122/31.2
7,499,632 B2 * 3/2009 Granger et al. ..... 392/386
8,033,292 B2 10/2011 Rustad et al.
8,033,532 B2 10/2011 Yabu
2007/0284765 A1 * 12/2007 Wang et al. ..... 261/142
2009/0096118 A1 * 4/2009 Brown et al. ..... 261/128

* cited by examiner

*Primary Examiner* — Charles Bushey
(74) *Attorney, Agent, or Firm* — J.C. Patents

(57) ABSTRACT

A thermal humidifier includes an upper housing provided with a steam outlet for conveying steam into a room and combined with a fundamental base having a PTC heating tube installed therein. A water-absorption member is mounted around the PTC heating tube and has a large portion soaked in a water box for absorbing liquid or water from the water box. The water-absorption member, after fully soaking up water, contacts with the PTC heating tube to enable the PTC heating tube to quickly heat the water of the water-absorption member to produce steam to be sent into a room through the steam outlet of the upper housing.

13 Claims, 4 Drawing Sheets

THERMAL HUMIDIFIER

BACKGROUND OF THE INVENTION

1. Field of the Invention

This invention relates to a thermal humidifier, particularly to one employed in a room in areas with comparatively dry climate or in dry seasons. The thermal humidifier of this invention functions to produce steam and convey the steam into a room for increasing indoor humidity after the steam is produced through heating to boil, thus preventing the room from becoming excessively dry or insufficient in humidity and avoiding a person's skin becoming excessively dry and causing itch.

2. Description of the Prior Art

A conventional humidifier generally uses a method of supersonic-wave high-speed oscillation to have water or liquid atomized and converted into atomized liquid through oscillation for over one million times per second and then, the atomized liquid is conveyed into a room by fans for humidifying the room, or uses a method of heating to heat water or liquid to boil for producing steam to be conveyed into a room by fans. Another conventional method of atomizing liquid, as disclosed in U.S. Pat. No. 8,033,292 and U.S. Pat. No. 8,033,532, is to heat liquid directly to produce steam by a heating element, but the speed of producing steam in this way is slow.

SUMMARY OF THE INVENTION

The objective of this invention is to offer a thermal humidifier provided with a water-absorption member for absorb liquid or water in a water tank. The water-absorption member is disposed around and contact with a PTC heating tube to enable the heating tube to quickly heat the water of the water-absorption member for producing steam to be conveyed into a room for increasing indoor humidity.

The water-absorption member of the thermal humidifier in the present invention is composed of water-absorption cotton strips, which can quickly absorb and convey liquid or water and are able to cope with the heating velocity of the heating tube, achieving effect of liquid or water atomization.

The water-absorption member of the thermal humidifier in the present invention has a large portion soaked in the water tank and another part passes around and contacts with the PTC heating tube (a heating tube of positive temperature coefficient) so that the PTC heating tube can quickly atomize liquid or water.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
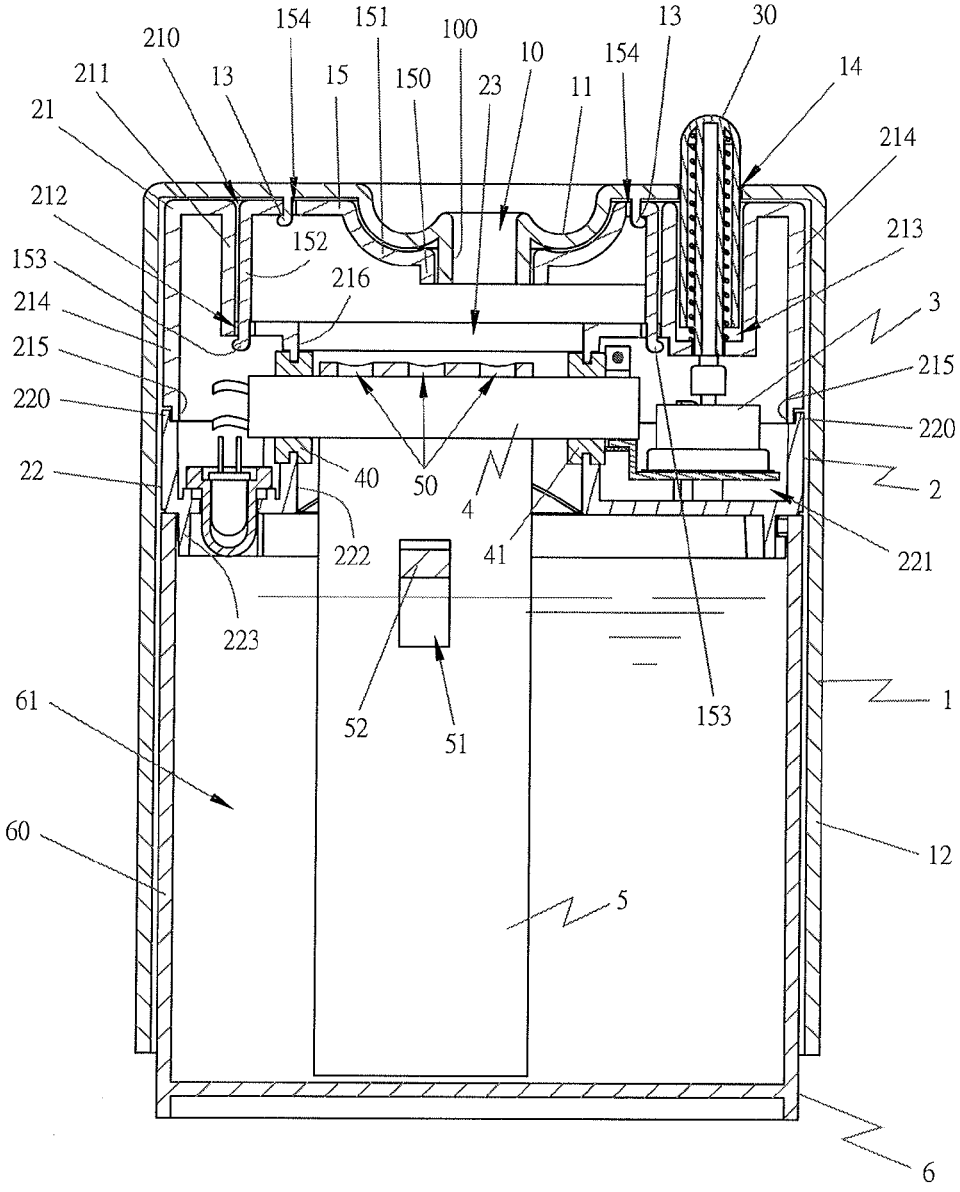
FIG. 1 is a cross-sectional view of a thermal humidifier in the present invention.
Figure 2:
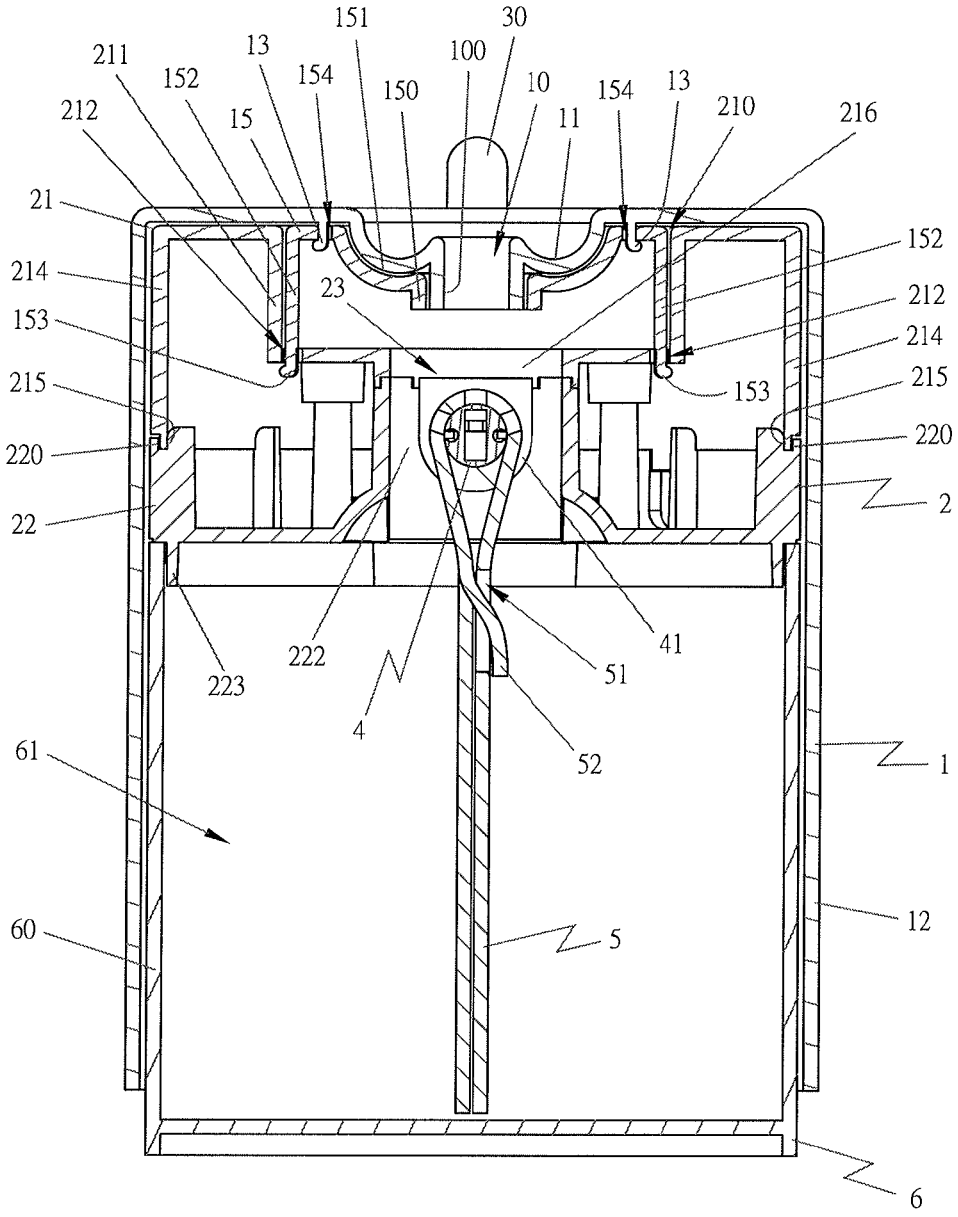
FIG. 2 is a side cross-sectional view of the thermal humidifier in the present invention.

A preferred embodiment of a thermal humidifier in the present invention, as shown in FIGS. 1 and 2, includes an upper housing 1, a fundamental base 2, a switch or control system 3, a PTC heating tube 4, a water-absorption member 5 and a water box 6 as main components combined together.

Figure 3:
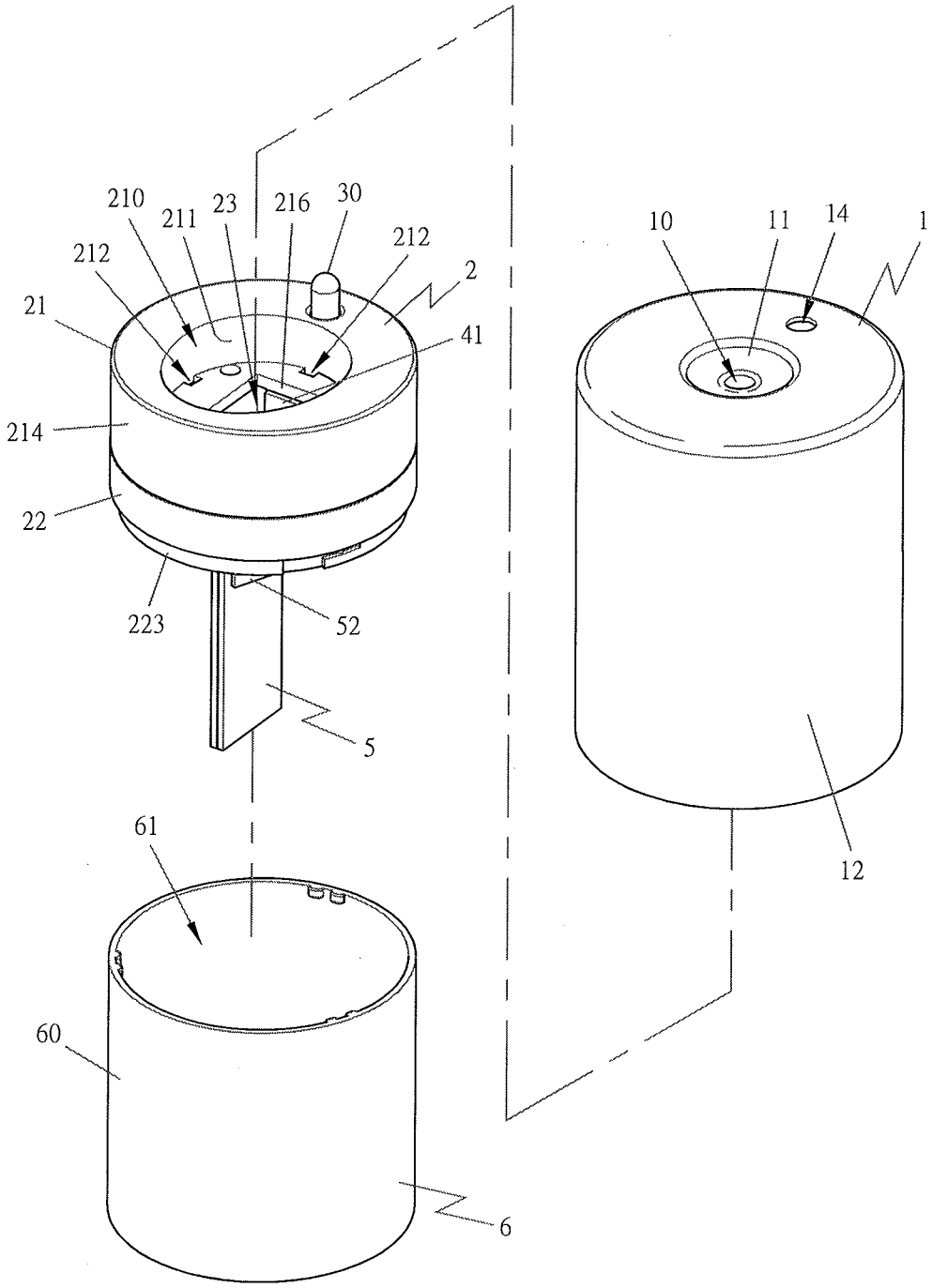
FIG. 3 is a partial exploded perspective view of the thermal humidifier in the present invention.

The upper housing 1 is provided with a steam outlet 10 formed with a circumferential side 100 and having its outer circumference formed with a concave face 11, further disposed with a circumferential side 12 extending downward to form an interior that is large enough to receive all the members of the thermal humidifier, as shown in FIGS. 1-3. The upper housing 1 is also provided with combination feet 13 at locations close to the steam outlet 10 to be respectively combined with the combination holes 154 of a steam-collecting member 15 for facilitating assembly and disassembly. Furthermore, the upper housing 1 is bored with an outlet 14 of a temperature-control switch for the temperature-control switch to extend out of the topside of the upper housing 1.

Referring to FIGS. 1 and 2, the upper housing 1 has its lower side set with a steam-collecting member 15 for collecting steam therein. The steam-collecting member 15 is formed with an inner circumferential side 150 to be combined with the circumferential side 100 of the steam outlet 10, and the inner circumferential side 150 has its periphery disposed with a concave face 151 corresponding with the concave face 11 at the outer circumference of the steam outlet 10 for enabling the steam-collecting member 15 and the upper housing 1 to be completely combined together.

The steam-collecting member 15 is further provided with an outer circumferential side 152 for steam to be collected and then conveyed into a room through the steam outlet 10, and the outer circumferential side 152 of the steam-collecting member 15 has an outer side of its lower end provided with one or more extension ends 153. Thus, the upper housing 1 can be fixed in position by having the outer circumferential side 152 of the steam-collecting member 15 leaning against the groove wall 211 of the combination groove 210 of a medium housing 21 of the fundamental base 2, and the steam-collecting member 15 can be combined together with the medium housing 21 of the fundamental base 2 by having the extension ends 153 of the steam-collecting member 15 respectively inserted through the combination holes 212 of the fundamental base 2. Additionally, the steam-collecting member 15 is bored with combination holes 154 at the inner side of the outer circumferential side 152 to be respectively combined with the combination feet 13 of the upper housing 1 for firmly combining the upper housing 1 and the steam-collecting member 15 together, as shown in FIGS. 1 and 3, thus facilitating the upper housing 1 and the steam-collecting member 15 to be assembled and disassembled.

The fundamental base 2 positioned under the steam-collecting member 15 of the upper housing 1 is provided with the medium housing 21 with a combination groove 210 for receiving the steam-collecting member 15 therein, as shown in FIGS. 1-3. As stated previously, the upper housing 1 and the fundamental base 2 can be combined together by having the groove wall 211 of the combination groove 210 leaning against the outer circumferential side 152 of the steam-collecting member 15. The medium housing 21 is bored with combination holes 212 whose number and location match with the number and the location of the extension ends 153 of the outer circumferential side 152 of the steam-collecting member 15.

As mentioned above, the medium housing 21 and the steam-collecting member 15 can be combined together by having the extension ends 153 of the outer circumferential side 152 of the steam-collecting member 15 respectively inserted through and engaged in the combination holes 212 of the medium housing 21. The medium housing 21 is disposed with a temperature-control switch groove 213 for receiving a temperature-control switch therein, further formed with an annular combination projection 215 at a lower side of the end of the outer sidewall 214 for combining a lower base 22 and provided with combination members 216 for combining a PTC heating tube 4. The inward portion of the combination member 216 is hollow so that steam can conveniently be conveyed out upward.

Referring to FIGS. 1-3, the fundamental base 2 contains the lower base 22 formed with an annular combination recess 220 to be combined with the annular combination projection 215 of the medium housing 21 for combining the lower base 22 together with the medium housing 21. The lower base 22 is formed with a switch groove 221 for receiving therein a switch or control system 3, the structure of which belongs to conventional technique and is unnecessary to make a superfluous statement. The switch or control system 3 is provided with a temperature-control switch 30 positioned in the temperature-control switch groove 213 of the medium housing 21 and extending out of the outlet 10 of the upper housing 1, letting a user operate the humidifier of this invention with easiness. The lower base 22 is provided with combination members 222 for securing the PTC heating tube 4 in the interior of the fundamental base 2 and disposed with a lower annular combination side 223 to be combined with the water box 6.

Referring to FIGS. 1-3, the PTC heating tube 4 is a heating member of positive temperature coefficient, provided with a left combination seat 40 and a right combination seat 41 respectively to be clamped by the clamping notches of both the combination members 216 of the medium housing 21 and the combination members 222 of the lower base 22 for keeping the PTC heating tube 4 in a stationary state.

Figure 4:
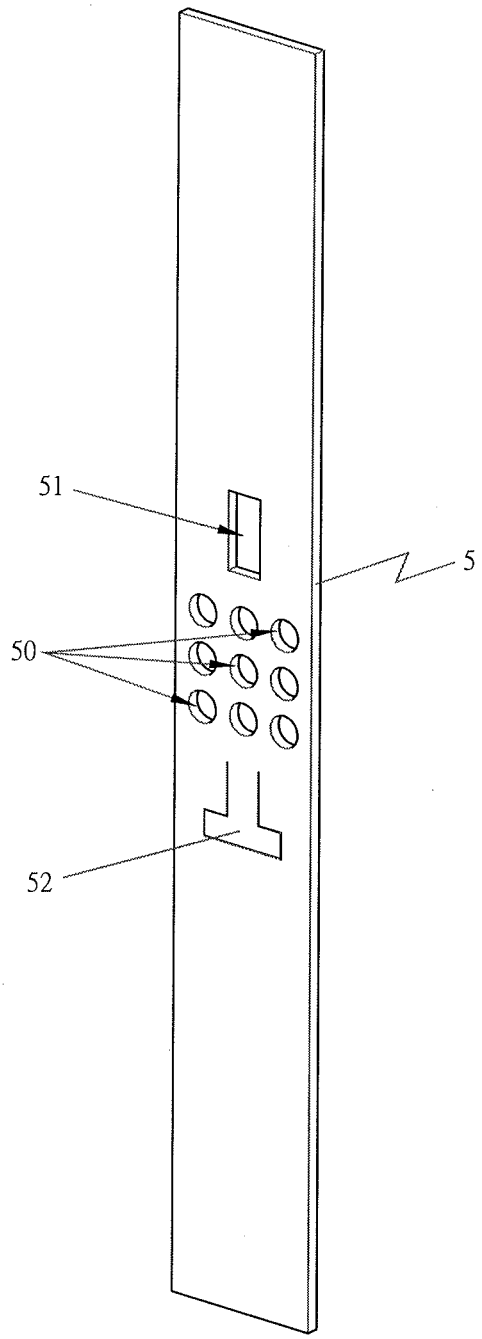
FIG. 4 is a schematic view of a water-absorption member of the thermal humidifier in the present invention.

The water-absorption member 5 passing around and contacting with the PTC heating tube 4 has a large portion soaked in the water box 6. The water-absorption member 5 made of non-woven fabric with high water-absorption rate or of other materials able to quickly absorb and convey water is provided with a plurality of holes 50, a combination hole 51 and an engage projection 52, as shown in FIG. 4. When the water-absorption member 5 is combined with the PTC heating tube 4, the plural holes 50 of the water-absorption member 5 must be at a proper location exactly contacting with the PTC heating tube 4, as shown in FIG. 1, and the engage projection 52 and the combination hole 51 of the water-absorption member 5 are jointed with each other, thus combining the water-absorption member 5 together with the PTC heating tube 4 and enabling the water-absorption member 5 to soak up water from the water box 6.

The water box 6 is formed with an annular wall 60 having an upper end combined with the lower annular combination side 223 of the lower base 22. The annular wall 60 is disposed with a water tank 61 for storing liquid or water. When extended in the water box 60, the water-absorption member 5 made of a material with high water-absorption rate can quickly absorb water from the water box 60 and guide the water to the PTC heating tube 4.

In operating, as shown in FIG. 3, when the upper housing 1 is removed from the fundamental base 2 by disengaging the extension ends 153 of the steam-collecting member 15 of the upper housing 1 from the combination holes 212 of the medium housing 21 of the fundamental base 2, an open groove 23 of the fundamental base 2 for accommodating the steam-collecting member 15 of the upper housing 1 will appear, facilitating the water-absorption member 5 to be replaced and assembled. To recombine the upper housing 1 together with the fundamental base 2, only carry out reversed operation. In addition, the fundamental base 2 and the water box 6 of the thermal humidifier of this invention can easily be separated from each other for adding water or other liquid in the water box 6.

The special feature of the thermal humidifier in the present invention is to have the water-absorption member 5 soaking up liquid or water from the water box 6 and contacting with the PTC heating tube 4 so that the PTC heating tube 4 can quickly heat the water of the water-absorption member 5 for produce steam to be conveyed into a room through the steam outlet 10 for increasing indoor humidity in due time to enable people to live in a comparatively comfortable and wholesome environment.

While the preferred embodiment of the invention has been described above, it will be recognized and understood that various modifications may be made therein and the appended claims are intended to cover all such modifications that may fall within the spirit and scope of the invention.

What is claimed is:

1. A thermal humidifier comprising:

an upper housing provided with a steam outlet for conveying steam into a room, said upper housing provided with a steam-collecting member, said upper housing combined with a fundamental base via said steam-collecting member; and said fundamental base installed therein with a PTC heating tube, a water-absorption member disposed around said PTC heating tube, said water-absorption member having a large portion soaked in the water tank of a water box, said water-absorption member absorbing liquid or water from said water box, said water-absorption member fully soaking up water and contacting with said PTC heating tube, said PTC heating tube quickly heating the water of said water-absorption member to produce steam to be conveyed into a room through said steam outlet of said upper housing wherein said fundamental base is provided with a medium housing and a lower base, said lower base is formed with an annular combination recess, said medium housing has an outer sidewall provided with an annular combination projection, said medium housing and said lower base are able to be combined together by having said annular combination recess of said lower base combined with said annular combination projection of said medium housing.

2. The thermal humidifier as claimed in claim 1, wherein said upper housing is provided with a circumferential side extending downward for receiving therein all the components of said thermal humidifier.

3. The thermal humidifier as claimed in claim 1, wherein said upper housing is combined with said steam-collecting member, said steam outlet of said upper housing formed with a circumferential side and having an outer circumference disposed with a concave face, said upper housing provided with combination feet, said steam-collecting member formed with an inner circumferential side, said inner circumferential side having periphery disposed with a concave face, said steam-collecting member bored with combination holes, said upper housing able to be combined with said steam-collecting member by having said circumferential side and said concave face and said combination feet of said upper housing respectively combined with said circumferential side and said concave face and said combination holes of said steam-collecting member.

4. The thermal humidifier as claimed in claim 3, wherein said steam-collecting member is provided with an outer circumferential side for collecting steam after said steam outlet of said upper housing is combined with said steam-collecting member and then, said steam is conveyed into a room through said steam outlet.

5. The thermal humidifier as claimed in claim 1, wherein said upper housing is combined with said fundamental base by having said steam-collecting member of said upper housing combined together with a medium housing of said fundamental base, said medium housing provided with a combination groove for receiving said steam-collecting member therein, said combination groove of said medium housing formed with a groove wall leaning against an outer circumferential side of said steam-collecting member, said outer circumferential side of said steam-collecting member having lower sides disposed with one or more extension ends to be respectively engaged with the combination holes of said medium housing, thus said upper housing able to be combined together with said fundamental base via mutual combination of said medium housing with said steam-collecting member.

6. The thermal humidifier as claimed in claim 1, wherein said medium housing of said fundamental base is provided with a combination member for combining said PTC heating tube, an inward portion of said combination member being hollow for facilitating steam to be conveyed out upward, said lower base of said fundamental base is provided with a combination member for combining said PTC heating tube, said PTC heating tube is disposed with a left combination seat and a right combination seat, said combination members of said medium housing and of said lower base respectively formed with clamping notches for respectively clamping and combining said left and said right combination seats of said PTC heating tube to keep said PTC heating tube in a stationary state.

7. The thermal humidifier as claimed in claim 1, wherein said water-absorption member is made of non-woven fabric with high water-absorption rate or of other materials able to quickly absorb and convey water.

8. The thermal humidifier as claimed in claim 1, wherein said water-absorption member is provided with plural holes, a combination hole and an engage projection, and said plural holes of said water-absorption member must be positioned at a proper place exactly contacting with said PTC heating tube when said water-absorption member is combined with said PTC heating tube, said combination hole and said engage projection combined mutually to have said water-absorption member and said PTC heating tube combined together, said water-absorption member absorbing water from said water box.

9. The thermal humidifier as claimed in claim 1, wherein said fundamental base is combined with said water box, said lower base of said fundamental base formed with a lower annular combination side, said water box formed with an annular wall having an upper end combined with said lower annular combination side of said lower base.

10. The thermal humidifier as claimed in claim 1, wherein said PTC heating tube is installed between said medium housing and said lower base.

11. A thermal humidifier comprising:

an upper housing provided with a steam outlet for conveying steam into a room, said upper housing provided with a steam-collecting member, said upper housing combined with a fundamental base via said steam-collecting member; and said fundamental base installed therein with a PTC heating tube, a water-absorption member disposed around said PTC heating tube, said water-absorption member having a large portion soaked in the water tank of a water box, said water-absorption member absorbing liquid or water from said water box, said water-absorption member fully soaking up water and contacting with said PTC heating tube, said PTC heating tube quickly heating the water of said water-absorption member to produce steam to be conveyed into a room through said steam outlet of said upper housing;

wherein said upper housing is combined with said steam-collecting member, said steam outlet of said upper housing is formed with a circumferential side and has an outer circumference disposed with a concave face, said upper housing is provided with combination feet, said steam-collecting member is formed with an inner circumferential side, said inner circumferential side has periphery disposed with a concave face, said steam-collecting member is bored with combination holes, said upper housing is able to be combined with said steam-collecting member by having said circumferential side and said concave face and said combination feet of said upper housing respectively combined with said circumferential side and said concave face and said combination holes of said steam-collecting member.

12. The thermal humidifier as claimed in claim 11, wherein said steam-collecting member is provided with an outer circumferential side for collecting steam after said steam outlet of said upper housing is combined with said steam-collecting member and then, said steam is conveyed into a room through said steam outlet.

13. A thermal humidifier comprising:

an upper housing provided with a steam outlet for conveying steam into a room, said upper housing provided with a steam-collecting member, said upper housing combined with a fundamental base via said steam-collecting member; and said fundamental base installed therein with a PTC heating tube, a water-absorption member disposed around said PTC heating tube, said water-absorption member having a large portion soaked in the water tank of a water box, said water-absorption member absorbing liquid or water from said water box, said water-absorption member fully soaking up water and contacting with said PTC heating tube, said PTC heating tube quickly heating the water of said water-absorption member to produce steam to be conveyed into a room through said steam outlet of said upper housing;

wherein said upper housing is combined with said fundamental base by having said steam-collecting member of said upper housing combined together with a medium housing of said fundamental base, said medium housing is provided with a combination groove for receiving said steam-collecting member therein, said combination groove of said medium housing is formed with a groove wall leaning against an outer circumferential side of said steam-collecting member, said outer circumferential side of said steam-collecting member has lower sides disposed with one or more extension ends to be respectively engaged with the combination holes of said medium housing, thus said upper housing is able to be combined together with said fundamental base via mutual combination of said medium housing with said steam-collecting member.

* * * * *